US006439904B1

(12) United States Patent
Hu et al.

(10) Patent No.: US 6,439,904 B1
(45) Date of Patent: Aug. 27, 2002

(54) ELECTRICAL CARD CONNECTOR WITH EJECTOR DEVICE

(75) Inventors: JunKui Hu; ZiQiang Zhu; Guohua Zhang, all of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/045,129

(22) Filed: Oct. 26, 2001

(51) Int. Cl.[7] ..... H01R 13/62

(52) U.S. Cl. ..... 439/159; 439/489; 439/488

(58) Field of Search ..... 439/159, 160, 439/488, 489, 910

(56) References Cited

U.S. PATENT DOCUMENTS 5,622,510 A * 4/1997 Ishida ..... 439/160
6,155,853 A * 12/2000 Kajiura ..... 439/159

* cited by examiner

*Primary Examiner*—Tho D. Ta
(74) *Attorney, Agent, or Firm*—Wei Te Chung

(57) ABSTRACT

An electrical card connector (1) includes an insulating housing (10) receiving a plurality of contacts (20) therein, and an ejector device attached to the insulating housing. The ejector device includes a driving member (30), an operating bar (40) connecting with the driving member at an end thereof and movable along a same direction as the extending direction of the contacts, and a retaining member (50) assembled to the housing. The operating bar defines an engaging portion for engaging with the retaining member.

10 Claims, 3 Drawing Sheets

ELECTRICAL CARD CONNECTOR WITH EJECTOR DEVICE

BACKGROUND OF THE INVENTION

1. Field of the Invention

The present invention relates to an electrical card connector, and particularly to an electrical card connector having an improved ejector device.

2. Description of Related Art

Integrated Circuit (IC) cards are widely used in personal computers, digital camera and other electrical devices. As disclosed in Taiwan Applications No. 83215629 and 84210015, a conventional electrical card connector is designed to receive an IC card for providing an electrical connection between the IC card and a printed circuit board on which the card connector is mounted. For facilitating removal of the IC card from the conventional card connector, an ejector device is employed. The ejector device commonly includes an operating bar, which is adapted to be driven by the user to eject the IC card, an acting bar exerting an ejecting force on the IC card, and a rotating bridge, one end of which connects with the operating bar and the other end connects with the acting bar. Thus, the operating bar drives the rotating bridge and the rotating bridge acts on the acting bar, thereby ejecting the IC card from the card connector.

However, in use, the user could not judge whether the IC card is ejected or not. Therefore, to ensure a complete ejection of the IC card, the operating bar must be driven to a terminal position. This will damage the operating bar and the rotating bridge after repeated use.

Hence, an electrical card connector with an improved ejector device is required to overcome the above-mentioned disadvantages.

BRIEF SUMMARY OF THE INVENTION

One object of the present invention is to provide an electrical card connector having an improved ejector device which can help the user to judge whether an inserted IC card is substantially ejected or not.

Another object of the present invention is to provide an electrical card connector having an improved ejector device which can protect the ejector device from damage during the process of ejecting an inserted IC card.

In order to achieve the afore-mentioned objects, an electrical card connector in accordance with the present invention comprises an insulating housing, a plurality of contacts received in the insulating housing, and an ejector device attached to the insulating housing. The ejector device includes a driving member configured as a flat plate, an operating member connecting with the driving member at an end thereof and movable along a same direction as the extending direction of the contacts, and a retaining member assembled to the housing. The retaining member is shaped as a rectangular plate with a rectangular opening defined therein. A plurality of barbs are formed on opposite longitudinal side edges of the retaining member to interfere with the housing. A resilient finger projects forwardly from an inner lateral edge of the retaining member, and extends outwards and then inwards. The operating member defines a first hole and a second hole aligned with each other for engaging sequentially with the resilient finger of the retaining member, so as to allow the user to correctly judge whether the inserted IC card is substantially ejected or not.

Other objects, advantages and novel features of the invention will become more apparent from the following detailed description of the present embodiment when taken in conjunction with the accompanying drawings.

DETAILED DESCRIPTION OF THE INVENTION

Figure 1:
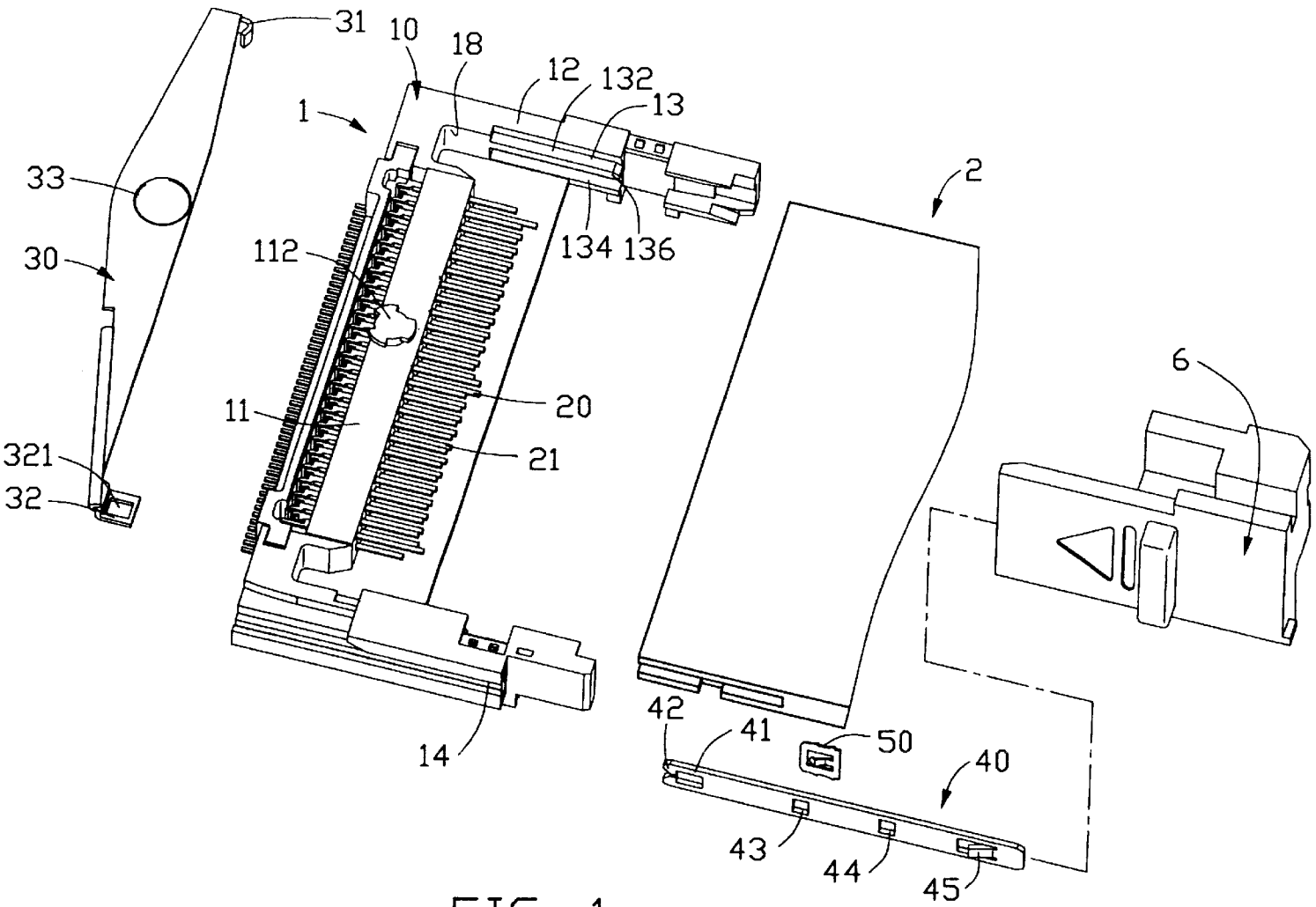
FIG. 1 is an exploded, perspective view of an electrical card connector with an ejector device in accordance with the present invention.
Figure 2:
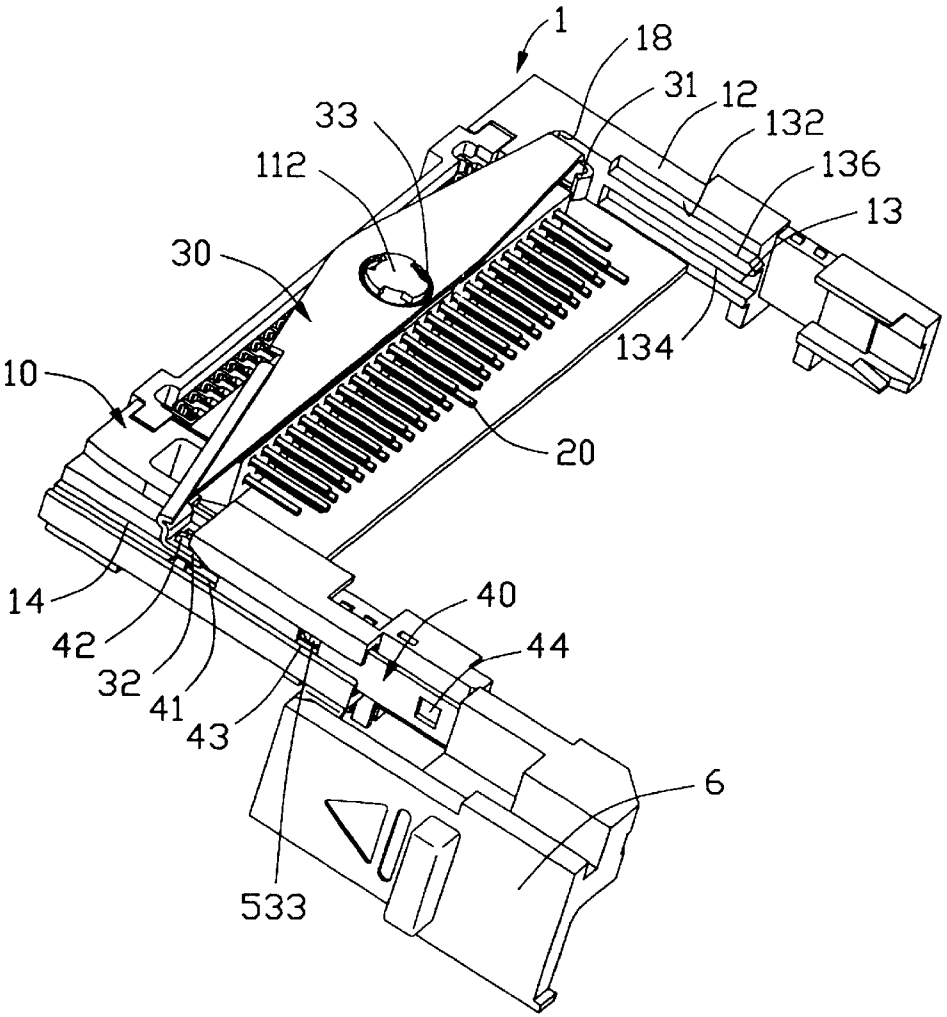
FIG. 2 is a perspective, assembled view of the electrical card connector with the ejector device shown in FIG. 1.
Figure 3:
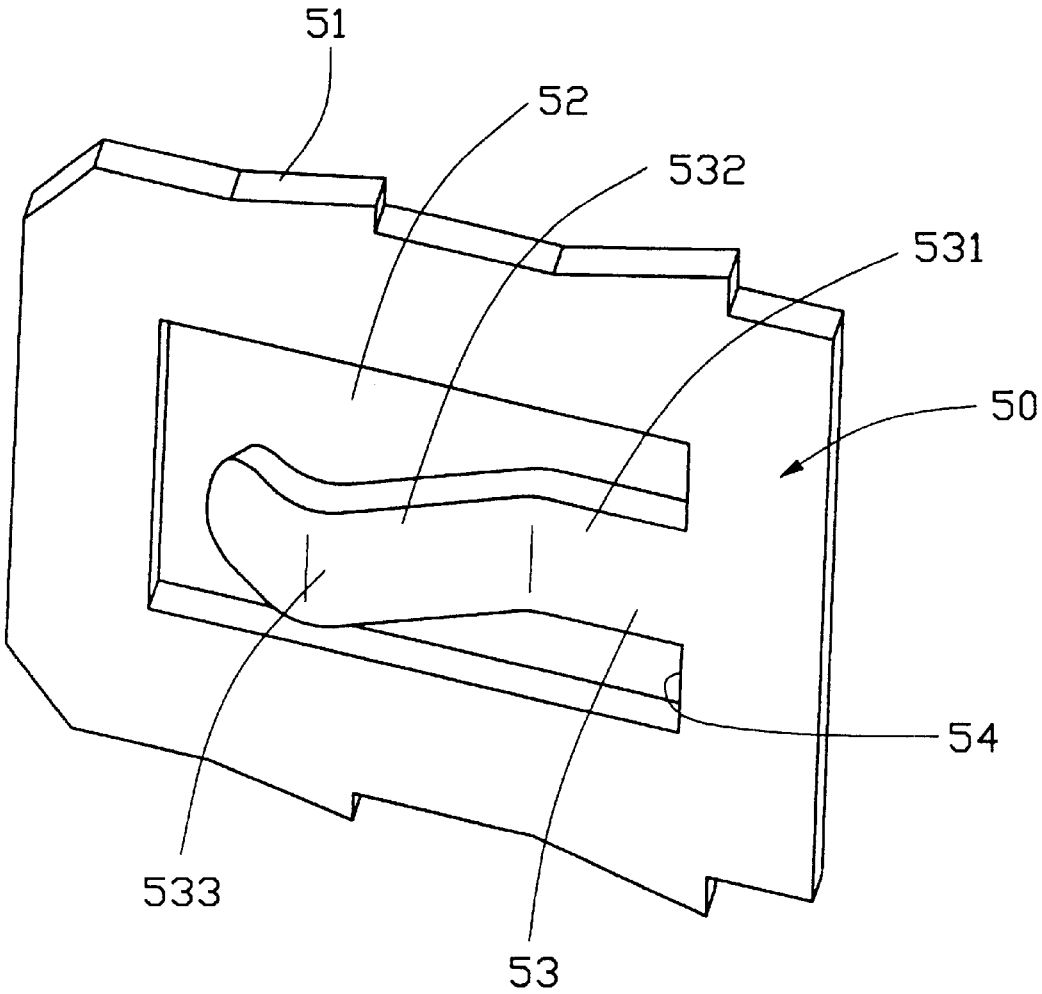
FIG. 3 is a perspective view of a retaining member of the ejector device of the electrical card connector.

Referring to FIGS. 1 to 3, an electrical card connector 1 for connecting an IC card 2 with a printed circuit board (not shown) on which the electrical card connector 1 is mounted, comprises an insulating housing 10 receiving a plurality of contacts 20 therein, an ejector device for ejecting the IC card 2, and a driving button 6 for receiving an external pushing force. The ejector device comprises a driving member 30 for exerting an ejecting force on the IC card 2 to remove the IC card 2, an operating bar 40 slideably received in the insulating housing 10, and a retaining member 50.

The insulating housing 10 includes an elongated main body 11 and two parallel guiding arms 12 extending perpendicularly and rearwardly from opposite lateral ends of the main body 11. A rectangular notch 18 is defined between each guiding arm 12 and the elongated main body 11. Each guiding arm 12 defines an inner guiding channel 13 in an inner surface thereof for engaging with a corresponding side edge of the IC card 2. A rib 136 divides the inner guiding channel 13 into an upper channel 132 and a lower channel 134, and is adapted for being received in a corresponding recess (not labeled) of the IC card 2. An outer guiding channel 14 is defined in an outer surface of one of the guiding arms 12 for assembling the operating bar 40 thereto. An engaging block 112 is formed in the middle of the main body 11 for engagement with the driving member 30.

The driving member 30 of the ejector device defines a through hole 33 in a center thereof for receiving and allowing rotation of the driving member 30 around the engaging block 112. A driving tab 31 is formed at one end of the driving member 30 to eject the IC card 2. An engaging tab 32 formed at the other end of the driving member 30 defines a rectangular slot 321 therein for joining with an end of the operating bar 40. The operating bar 40 is configured as an elongated metal plate. An engaging end 41 is provided at one end of the operating bar 40 with a fork-shaped portion 42 formed thereon for engaging with the engaging tab 32. The operating bar 40 horizontally defines a first rectangular hole 43 and a second rectangular hole 44 aligned with each other for engaging with the retaining member 50 sequentially. The distance between the first and second holes 43, 44 of the operating bar 40 is larger than or equal to the engaging length of the contacts 20 and the IC card 2 so as to ensure a complete ejection of the IC card 2 from the electrical card connector 1. The so-called engaging length of the contacts 20 and the IC card 2 substantially refers to the length of the longest contacting portion 21 of the contacts 20. A resilient tab 45 is formed on the other end opposite to the engaging end 41 for securing the driving button 6 thereto.

Referring to FIG. 3, the retaining member 50, which is shaped in a rectangular metal plate, is fixed into the outer guiding channel 14 of the insulating housing 10 proximate to the operating bar 40 along a same direction as inserting the IC card 2. A plurality of barbs 51 are formed at opposite longitudinal side edges of the retaining member 50 to interference fit in the outer guiding channel 14 of the guiding arm 12. A rectangular opening 52 is defined in the middle of the retaining member 50 and a resilient finger 53 extends forwardly from an inner lateral edge 54 of the retaining member 50. The resilient finger 53 includes a base portion 531 extending from the inner lateral edge 54 and a resilient portion 533 projecting from the base portion 531 and extending outwardly and then inwardly.

As shown in FIG. 2, when the IC card (not shown in this figure) is in an electrical connection state with the plurality of contacts 20 of the electrical card connector 1, the driving tab 31 of the driving member 30 is received in a corresponding notch 18 of the insulating housing 10. The engaging tab 32 engages with the engaging end 41 of the operating bar 40 whereby the fork-shaped portion 42 is received in the rectangular recess 321 of the engaging tab 32. The retaining member 50 interference fits with inner upper and lower walls of the outer channel by the barbs 51 thereon and the resilient portion 533 of the retaining member 50 is retained in the first hole 43. When the IC card 2 is required to be ejected from the electrical card connector 1, the user can push the driving button 6 towards the main body 11. The resilient tab 45 of the operating bar 40 engages with a corresponding part of the driving button 6, whereby the operating bar 40 moves in the same direction as the driving button 6. The first hole 43 disengages from the resilient finger 53 and the second hole 44 moves towards the resilient finger 53. When the engaging end 41 pushes the engaging tab 32 to the terminal position and the driving tab 31 drives the IC card 2 away from the main body 11, the resilient portion 533 enters into the second hole 44 of the operating bar 40. Thus, due to the sequential engagement between the resilient portion 533 of the retaining member 50 and the first and the second holes 43, 44, the user can judge definitely whether the IC card is ejected out or not through the tactility.

It should be understood that the above description is only a preferred embodiment illustrating the main concept of the present invention, and some changes may be made to the structure. These changes may comprise changing the first and the second holes 43, 44 of the operating bar 40 into two protrusions, and correspondingly, changing the retaining member 50 to have a recess to engage with the protrusions sequentially. These changes may also comprise defining one hole in the operating bar 40 but providing two retaining members 50 in the outer guiding channel 14 to be sequentially hold in the hole of the operating bar 40. These changes can achieve the same function as the above-mentioned embodiment, and are within the skill of one ordinary artisan. The distance between the two protrusions of the operating bar or the two retaining members is at least equal to the minimum travel distance of the IC card during ejection allowing removal of the user.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical card connector mounted on a circuit board for receiving an integrated circuit (IC) card, comprising:

an insulating housing having a main body and a pair of guiding arms extending rearwardly from opposite ends of the main body;

a plurality of contacts received in the main body of the insulating housing, each contact having a contacting portion adapted for engaging with the IC card; and an ejector device attached on the insulating housing, the ejector device comprising a driving member adapted for ejecting the IC card, an operating bar assembled to one of the guiding arms and connecting with the driving member, a driving button connected to the operating bar for receiving an external pushing force and a retaining member secured to said one guiding arm and situated proximate to the operating bar; wherein the operating bar is moveable along the guiding arms, and the retaining member is snappingly engagable with the operating bar during the movement of the operating bar, so as to allow a user to observe the retaining member and judge definitely whether the IC card is ejected out or not through the tactility.

2. The electrical card connector as claimed in claim 1, wherein the retaining member forms a plurality of barbs on opposite longitudinal side edges thereof for interfering with said one guiding arm.

3. The electrical card connector as claimed in claim 1, further comprising a driving button for exerting an external force on the operating bar.

4. The electrical card connector as claimed in claim 1, wherein the retaining member comprises a resilient finger extending outwardly and then inwardly towards the main body of the insulating housing, and the operating bar comprises a first hole and a second hole for engagement with the resilient finger.

5. The electrical card connector as claimed in claim 4, wherein the distance between the first and second holes is equal to or larger than the length of the contacting portion of each contact.

6. The electrical card connector as claimed in claim 1, wherein the driving member connects to the operating bar at one end thereof and forms a driving tab at the other end adapted for ejecting the IC card.

7. The electrical card connector as claimed in claim 6, wherein the driving member includes a hole defined in the center.

8. The electrical card connector as claimed in claim 7, wherein the main body of the housing forms an engaging block thereon for being received in the hole of the driving member and the driving member rotates about the engaging block.

9. An electrical card connector comprising:

an insulative housing defining a main body and a pair of guiding arms extending rearwardly from opposite ends of the main body;

a plurality of contacts received within the body;

an ejector device attached to the housing, said ejector device comprising a driving members, an operating bar connected to said driving member and guidably moved along one of said guiding arms and a driving button connected to the operating bar for receiving an external pushing force;

at least one retaining hole formed in one of said operating bar and said one of said guiding arms, and at least one retaining finger disposed on the other of said operating bar and said one of said guiding arms for retaining the operating bar in position relative to the housing; wherein the operating bar is moveable along the guiding arms, and the at least one retaining finger is snappingly engagable with the at least one retaining hole during the movement of the operating bar, so as to allow a user to observe the retaining finger and judge definitely whether the IC card is ejected out or not through the tactility.

10. The connector as claimed in claim 9, wherein there is another retaining finger vs. hole arrangement formed along said one of said guiding arms so that the operating bar defines two operation positions along said one of said guiding arms.

* * * * *